US008628002B2

(12) United States Patent
Yamazaki et al.

(10) Patent No.: US 8,628,002 B2
(45) Date of Patent: Jan. 14, 2014

(54) PACKING BOX AND MANUFACTURING METHOD THEREOF

(75) Inventors: Masahiro Yamazaki, Chiyoda-ku (JP); Katsuhiko Hayashida, Chiyoda-ku (JP); Masaomi Takeda, Chiyoda-ku (JP); Akihisa Yokoyama, Chiyoda-ku (JP)

(73) Assignee: Mitsubishi Electronic Corporation, Tokyo, Chiyoda-Ku (JP)

( * ) Notice: Subject to any disclaimer, the term of this patent is extended or adjusted under 35 U.S.C. 154(b) by 0 days.

(21) Appl. No.: 13/130,185

(22) PCT Filed: Jan. 14, 2009

(86) PCT No.: PCT/JP2009/050333

§ 371 (c)(1),
(2), (4) Date: May 19, 2011

(87) PCT Pub. No.: WO2010/082309

PCT Pub. Date: Jul. 22, 2010

(65) Prior Publication Data

US 2011/0226846 A1 Sep. 22, 2011

(51) Int. Cl.
*B65D 5/28* (2006.01)

(52) U.S. Cl.
USPC ..... 229/191; 229/918; 493/89

(58) Field of Classification Search
USPC ..... 229/191, 199, 199.1, 915, 918; 493/89
See application file for complete search history.

(56) References Cited

U.S. PATENT DOCUMENTS

| | | | | |
|---|---|---|---|---|
| 2,315,105 | A * | 3/1943 | Bonfield | 229/199 |
| 2,801,740 | A * | 8/1957 | Fallert | 229/918 |
| 2,885,140 | A | 5/1959 | Guyer | |
| 3,014,413 | A * | 12/1961 | McKinley | 493/89 |
| 3,079,058 | A * | 2/1963 | Russell | 229/191 |
| 3,159,326 | A * | 12/1964 | Stonebanks | 229/199 |
| 3,310,219 | A * | 3/1967 | Dlugopolski | 229/919 |
| 4,613,045 | A * | 9/1986 | Watson | 206/512 |
| 6,378,764 | B1 * | 4/2002 | Teixidor Casanovas | 229/191 |
| 7,246,737 | B2 * | 7/2007 | Teixidor Casanovas | 229/191 |
| 2003/0094484 | A1 * | 5/2003 | Chu | 229/191 |

FOREIGN PATENT DOCUMENTS

| | | | | |
|---|---|---|---|---|
| DE | 2816563 | A1 | 10/1979 | |
| EP | 76883 | A1 * | 4/1983 | 229/191 |
| EP | 0076883 | A1 | 4/1983 | |
| ES | 2220165 | A1 | 12/2004 | |

(Continued)

OTHER PUBLICATIONS

International Search Report (PCT/ISA/210) issued on Apr. 21, 2009, by Japanese Patent Office as the International Searching Authority for International Application No. PCT/JP2009/050333.

(Continued)

*Primary Examiner* — Gary Elkins

(74) *Attorney, Agent, or Firm* — Buchanan Ingersoll & Rooney PC

(57) ABSTRACT

A packing box comprising a rectangular bottom plate and a plurality of side plates erected from the periphery of the bottom plate and surrounding the bottom plate, in which at four corners in corner parts formed by the plurality of side plates, frame columns, each erected from the bottom plate side and extending to the midway to a distal end of the side plates, are formed and joined to the side plates, and the bottom plate, the side plates, and the frame columns are formed by one corrugated fiberboard sheet.

7 Claims, 5 Drawing Sheets

(56) References Cited

FOREIGN PATENT DOCUMENTS

| | | | | | |
|---|---|---|---|---|---|
| JP | 58-020643 | A | | 2/1983 | |
| JP | 58-088320 | U | | 6/1983 | |
| JP | 63-105687 | U | | 7/1988 | |
| JP | 2-98549 | A | * | 4/1990 | ..... 206/512 |
| JP | 4-062615 | U | | 5/1992 | |
| JP | 5-010228 | U | | 2/1993 | |
| JP | 5-132081 | A | | 5/1993 | |
| JP | 3028769 | U | | 6/1996 | |
| JP | 2002-264926 | A | | 9/2002 | |
| JP | 2003-104366 | A | | 4/2003 | |

OTHER PUBLICATIONS

Office Action from Japanese Patent Office dated Apr. 16, 2013, issued in corresponding Japanese Patent Appln. No. 2010-546492, with English translation thereof (4 pages).

Chinese Office Action for corresponding Chinese Application No. 2009801532366 dated Nov. 5, 2012, with English-language translation, 12 pages.

Japanese Office Action for corresponding Japanese Application No. 2010-546492 dated Nov. 6, 2012, with English-language translation, 6 pages.

European Search Report for corresponding European Application No. 09838279.9 dated Nov. 30, 2012, 5 pages.

Office Action dated May 16, 2013 issued in corresponding Chinese Patent Application No. 200980153236.6 and English-language translation, 14 pps.

Office Action issued in a corresponding European Patent Application No. 09838279.9-1708, dated Oct. 31, 2013, 5 pages.

Office Action issued in corresponding Chinese Patent Application No. 2009801532366 dated Sep. 30, 2013, and English-language translation, 15 pps.

* cited by examiner

PACKING BOX AND MANUFACTURING METHOD THEREOF

TECHNICAL FIELD

The present invention relates to a packing material of a product such as electric appliances and particularly to a packing box applied to an upper part or a lower part of the product.

BACKGROUND ART

A packing device composed of an upper corrugated fiberboard which covers the upper part of a product such as electric appliances, a lower corrugated fiberboard placed under the product, and columns brought into contact with sides of the product and arranged between the upper and lower corrugated fiberboards, and fastening those corrugated fiberboards with a band so as to fix them is known (Patent Document 1, for example).

Also, in a box body formed by punching a single corrugated fiberboard sheet, a corrugated fiberboard box for packing in which corner columns are disposed at four corners of the box by tucking in extension parts of both ends of a pair of side plates opposing each other with a bottom plate between them is also known (Patent Document 2, for example).

[Patent Document 1] Japanese Unexamined Patent Application Publication No. 5-132081

[Patent Document 2] Japanese Unexamined Utility Model Registration Application Publication No. 5-10228

DISCLOSURE OF INVENTION

Problems to be Solved by the Invention

However, in the packing device in which the columns brought into contact with the sides of the product are inserted between the upper corrugated fiberboard and the lower corrugated fiberboard, the number of components is increased by the columns, assembling requires time, and there are problems in cost and workability.

Also, the corrugated fiberboard box with the corner columns being disposed at the four corners of the box is intended to contain a product within the box, and in addition that the shape becomes large, it requires more work to put/take the product in/out of the box, and there is also a problem in cost and workability.

The present invention was made in order to solve the above problems and has an object to provide a packing box that can prevent collapsing or damage on the product during storage in a warehouse or physical distribution and transportation and moreover, does not take labor when being mounted on the product and has good workability.

Means for Solving the Problems

A packing box of the present invention has a rectangular bottom plate and a plurality of side plates erected from the periphery of the bottom plate and surrounding the bottom plate, in which at four corners in corner parts formed by the plurality of side plates, frame columns, each erected from the bottom plate side and extending to the midway to a distal end of the side plate, are formed and joined to the side plates, and the bottom plate, the side plates, and the frame columns are formed by one corrugated fiberboard sheet.

A manufacturing method of a packing box of the present invention is a method of punching one corrugated fiberboard sheet and forming a box board having a rectangular bottom plate, four side plates extending from individual sides of the bottom plate, and extended parts extending from both ends of each two-opposing side plate on the bottom plate side out of the four side plates and each having a width W2 smaller than a width W1 of the side plates, forming four frame columns by tucking each of the extended parts inward, forming a box body by folding each of the side plates, and arranging the four frame columns at four corners of the box body and joining them to the side plates.

Advantages

In the packing box of the present invention, since the frame columns, each erected from the bottom plate side and extending to the midway of the distal end of the side plate, are formed at the four corners of the box and joined to the side plates, by arranging the frame columns in contact with an upper face or a lower face of the product, collapsing or damage of the product can be reduced. This is because the compression strength (or buckling strength) of the packing box is improved by the frame columns formed at the four corners of the box. Also, since the packing box has an open face opposing the bottom plate, it can be easily arranged over or below the product. Moreover, since the side plates are in a form protruding long from the frame columns, the protruding portions of the side plates cover the side end portions, and damages on the product can be reduced when the product is arranged side by side, and contribution is made to reduction of displacement of the packing box.

In the manufacturing method of the packing box of the present invention, only with a work of folding a punched corrugated fiberboard sheet, the box body having the frame columns with the height lower than the height of the side plates and excellent compression strength can be formed. Also, since the frame columns are joined to the side plates of the box body, the compression strength of the packing box is further improved.

REFERENCE NUMERALS

Figure 1:
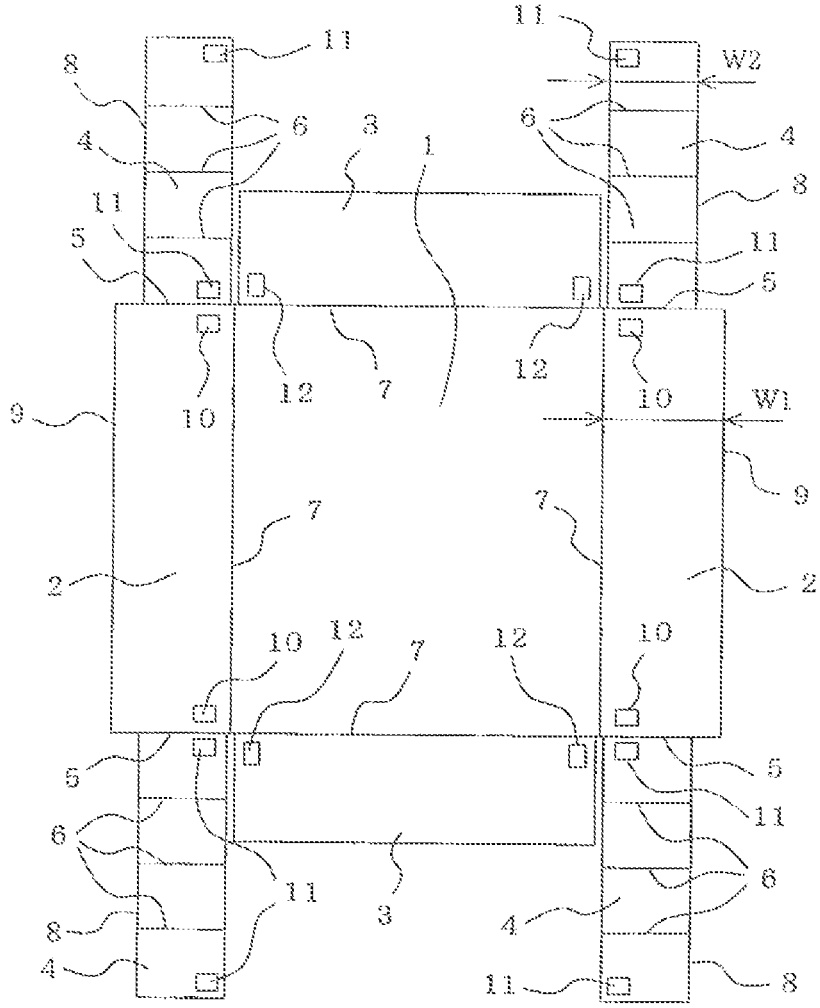
FIG. 1 is an extended plan view of a packing box according to Embodiment 1 of the present invention in an extended state.

1 bottom plate
2, 3 side mate
4 extended part
5, 6, 7 folding line
8 outer edge of extended part
9 outer edge of side plate 2
10, 11, 12 hole
14 frame column

14A multiple frame column
15 section part of frame column
16 joining member
17 side plate distal end part
18 staple
19 supporting material
20 packing box
25 pallet
30 product
31 top face of product
32 side face of product
35 product
36 bottom face of product
37 side face of product

BEST MODES FOR CARRYING OUT THE INVENTION

Embodiment 1

Figure 2:
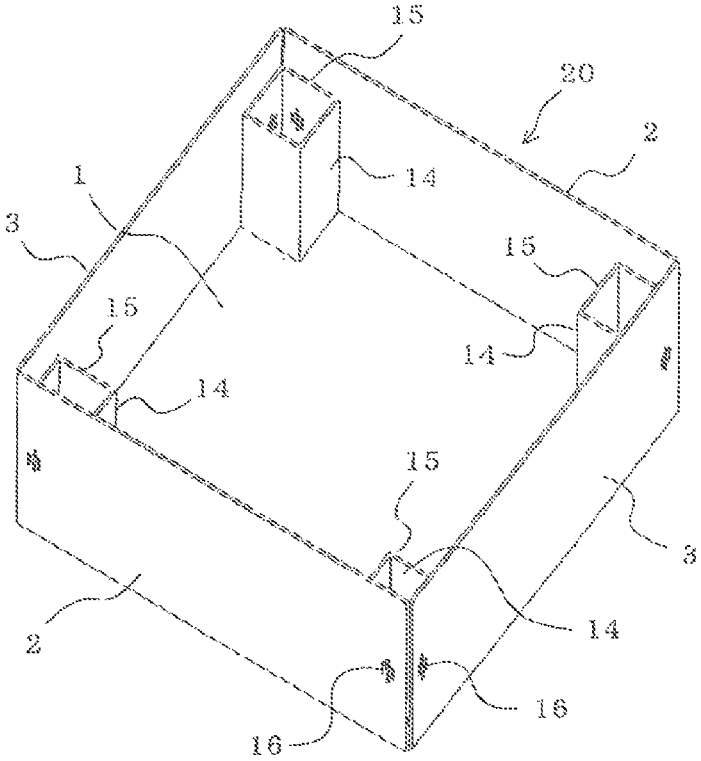
FIG. 2 is a perspective view illustrating a completed state of the packing box according to the extended view of FIG. 1.

Embodiments of the present invention will be described below while referring to the attached drawings. FIG. 1 is an extended plan view of a packing box 20 according to Embodiment 1 of the present invention in an extended state, and FIG. 2 is a perspective view of the packing box 20 according to the extended view of FIG. 1 in a completed state.

The packing box of Embodiment 1 is formed by folding a single corrugated fiberboard sheet. FIG. 1 is a box board before folding obtained by punching a single corrugated fiberboard sheet. This box board has a pair of side plates 2 formed extending from one of opposing and edges of a bottom plate 1 and a pair of side plates 3 extending from the other opposing end edges, respectively, around a rectangular bottom plate 1. In boundary parts between the bottom plate 1 and the side plate 2 or the side plate 3, folding lines 7 are formed, respectively. Widths W1 of the side plates 2 and the side plates 3 from the bottom plate 1 do not have to be the same but usually, they are supposed to be the same.

From the respective both ends of the pair of side plates 2, extended parts 4 to be frame columns 14 are extended, respectively. The extended parts 4 extend from the both ends of the side plates 2 on the bottom plate side, and a width W2 of the extended part 4 is smaller than the with W1 of the side plate 1. That is, an outer edge 9 of the side plate 2 is formed in a mode protruding from an outer edge 8 of the extended part 4. Also, in boundary parts between the side plate 2 and the extended part 4, folding lines 5 are formed, and in the extended parts 4, a plurality of folding lines 6 in parallel with the folding lines 5 are further formed.

Moreover, the board is configured that holes 10 are formed in the both end portions of the side plate 2, holes 11 in the both end portions of the extended parts 4, and holes 12 in the both end portions of the side plate 3. When the box board is assembled into a box body, these holes form through holes such that the holes 10 and the holes 11 as well as the holes 11 and holes 12 form through holes, respectively.

Subsequently, an example of a procedure to assemble the box board in FIG. 1 into a form of the packing box 20 shown in FIG. 2 will be described. First, the side plates 2 are folded along the folding lines 7 and installed upright (stood up) from the bottom plate 1. Then, the extended parts 4 extending from the side plate 2 are folded inward along the folding lines 5, and moreover, along the folding lines 6, the extended parts 4 are sequentially folded inward so as to form the frame columns 14. Each of the frame columns 14 is made into a polygonal body with a section part 15 of the frame column 14 in the shape of a triangle or a square depending on the number of folding times. Then, the side plates 3 are folded along the folding lines 7 in the same direction as the side plates 2 and installed upright (stood up) from the bottom plate 1 so as to form a box body. The procedures up to this may be exchanged as appropriate.

Subsequently, each time column 14 is arranged at the four corners of the box body such that the outer two faces of each frame column 14 formed from the extended part 4 are brought into contact with inner faces of the adjacent side plates 2 and 3 folded and constituting the corner parts of the box body.

Then, the holes 10 disposed in the side plates 2 and the holes 11 disposed in the extended parts 4 are overlapped so as to form through holes. Also, the holes 12 disposed in the side plates 3 and the holes 11 disposed in the extended parts 4 are overlapped so as to form through holes. Then, joining members 16 are inserted into the through holes, and the side plates 2 and the frame columns 14 as well as the side plates 3 and the frame columns 14 are joined together and fixed so that the side plates 2 and 3 are integrated with the frame columns 14. The joining member 16 may be a fastening tool formed from resin or metal such as a bolt and a nut or rivet. As a result, the packing box 20 according to Embodiment 1 is completed.

Figure 3:
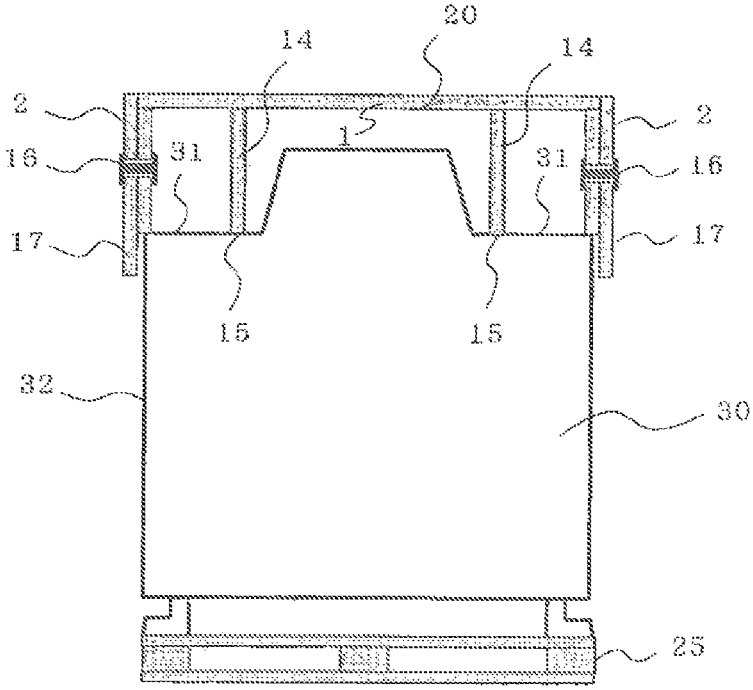
FIG. 3 is an exemplification diagram illustrating a use mode of the packing box according to Embodiment 1.
Figure 4:
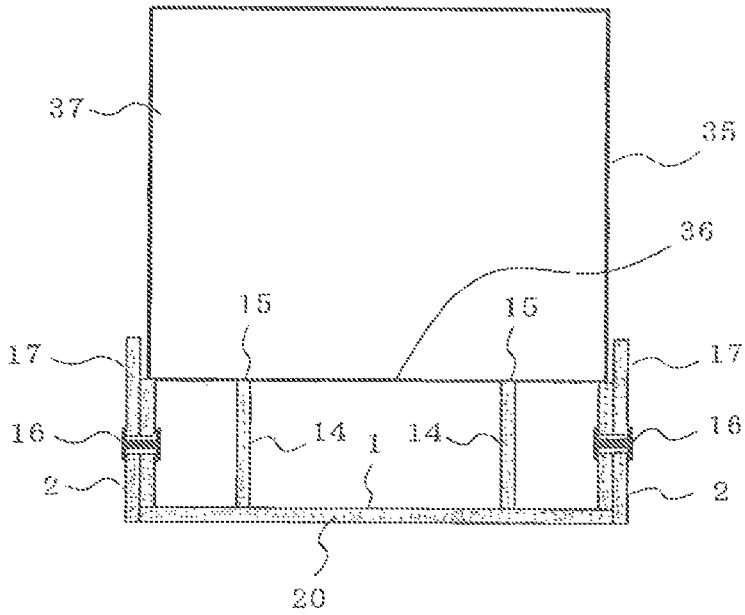
FIG. 4 is an exemplification diagram illustrating another use mode of the packing box according to Embodiment 1.

Subsequently, a use example of the packing box 20 will be described. FIG. 3 is an exemplification diagram illustrating a use mode of the packing box 20 according to Embodiment 1. Here, a state in which the packing box 20 is installed on a top face (upper part) 31 of a product 30, and a pallet 25 is arranged on a bottom face (bottom park) of the product 30 is illustrated. Since the frame columns 14 formed by tucking the extended parts 4 inward are installed with the section parts 15 in contact with the four corners on the top face 31 of the product 30, compression strength in the vertical direction of the packing box 20 is increased. Also, since the packing box 20 has increased compression strength in the vertical direction, it can be used on the bottom face (bottom part) 36 of the product 35 as shown in FIG. 4. That is, the packing box 20 can stably protect the upper part or the lower part of the product and can also sufficiently withstand stacking of the products during storage and transportation.

Also, as described above, the width W2 of the extended part 4 is formed smaller than the width W1 of the side plate 2. As a result, the frame column 14 formed by tucking the extended part 4 inward stands up from the bottom plate 1 side and extended to the middle from the bottom plate to the distal end portion of the side plate 2. That is, the distal end portion of the side plate 2 (hereinafter referred to as a side plate distal end portion 17) constitutes, as shown in FIGS. 3 and 4, an outer periphery part protruding from the frame column 14. Usually, the distal end portion of the side plate 3 (hereinafter referred to as side plate distal end portion 17) also constitutes an outer periphery part protruding from the frame column 14. These side plate distal end portions 17 give the following advantages.

If displacement of the products 30 with the packing boxes 20 stacked in plural stages are to be corrected, a force by a human being or a forklift is applied in the lateral direction to the pallet 25 or the like arranged on the bottom part of the boxes stacked above. At this time, the side plate distal end portion 17 of the packing box 20 arranged on the top face 31 of the product 30 arranged in the lower stage is engaged with a side face 32 of the corresponding product 30. By means of this engagement, displacement of the packing box 20 located in the lower stage with respect to the corresponding product 30 is prevented. Also, since direct contact between the side faces of the products 30 and 35 arranged side by side can be avoided by this side plate distal end portion 17, the product side faces 32 and 37 can be protected.

Figure 5:
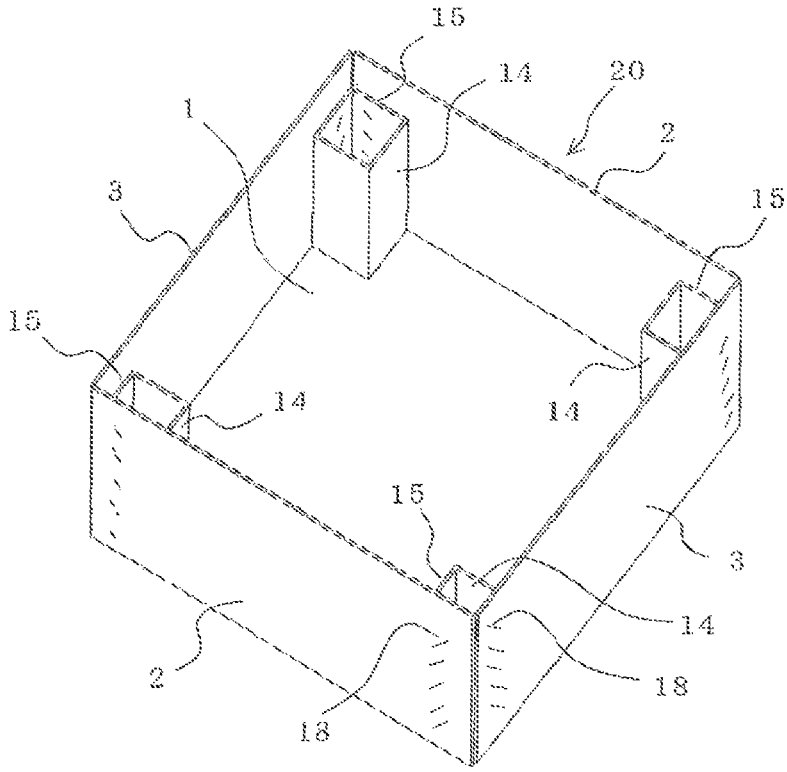
FIG. 5 is a perspective view illustrating another packing box according to Embodiment 1 of the present invention.

The frame columns 14 and the side plates 2 and 3 can be joined together and integrated by hitting staples 18 made of metal or the like into the side plates 2 and 3 and the frame columns 14 as shown in FIG. 5 in addition to the method using the holes shown in FIGS. 1 to 4. The staples 21 are preferably penetrated into the inner face side of the frame columns 14 from the outer face side of the side plates 2 and 3. As a result, since a work such as alignment of the holes in the side plates 2 and 3 and the extended parts 4 or insertion of the joining member 16 into the through hole is no longer necessary, and the manufacture of the packing box 20 can be further simplified.

Embodiment 2

Figure 6:
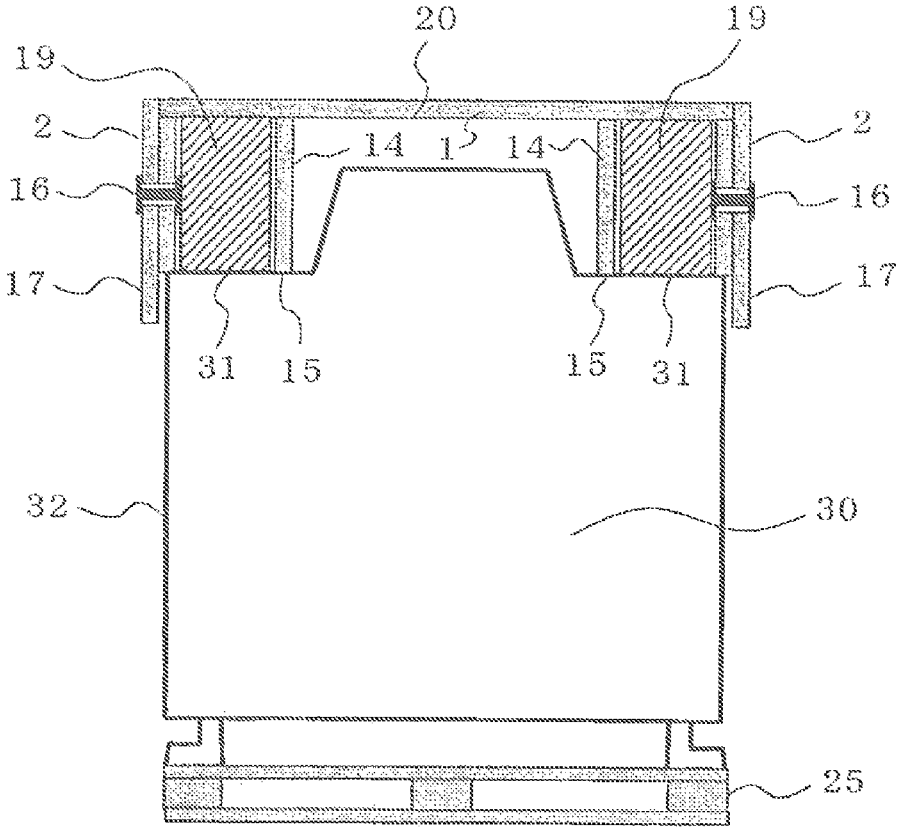
FIG. 6 is an exemplification diagram illustrating a packing box according to Embodiment 2 of the present invention and a use mode thereof.

FIG. 6 is an exemplification diagram illustrating a packing box according to Embodiment 2 of the present invention and its use mode. As shown in FIG. 6, this packing box 20 is filled with a supporting material 19 that increases strength of the frame column 14 inside the frame column 14. The supporting material 19 can be filled by a method of having the supporting material 19 contained when the frame column 14 is formed and tucking the extended part 4 or by a method of inserting the supporting material 19 into the frame column 14 after the frame column 14 is formed. Resin and lumber is suitable for the supporting material 19. According to this, since the compression strength of the supporting material 19 is added to the compression strength of the frame column 14 formed by a corrugated fiberboard sheet, the effect of the packing box 20 described in Embodiment 1 can be further improved.

Embodiment 3

Figure 7:
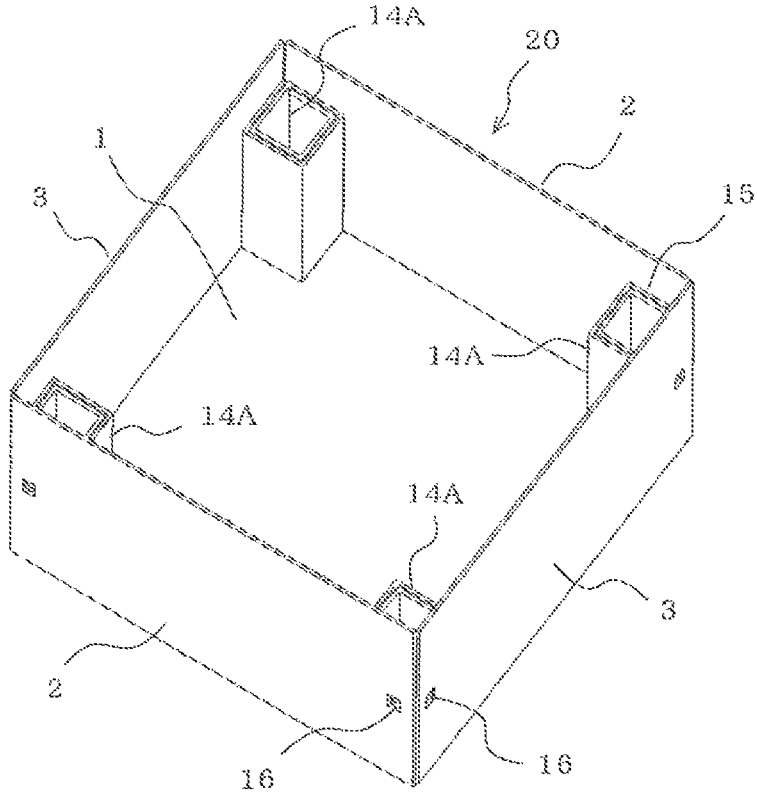
FIG. 7 is a perspective view illustrating a packing box according to Embodiment 3 of the present invention.

FIG. 7 is a perspective view illustrating a packing box according to Embodiment 3 of the present invention. As Shown in FIG. 7, this packing box 20 has a multiple frame column 14A made of a multiple sheet as the frame column by tucking the extended part 4 of the side plate 2 inward doubly or more. Since this multiple frame column 14A has the compression strength larger than the frame column 14 in Embodiment 1, the effect of the packing box 20 described in Embodiment 1 can be further improved.

The effects of the packing box 20 described in each of Embodiments can be summarized as follows.

(1) Only with a work of folding a single punched corrugated fiberboard sheet, a box body for the packing box 20 having the frame columns 14 lower than the peripheral side plates 2 and 3 at the four corners can be formed.

(2) Since the frame columns 14 are joined to the side plates 2 and 3 of the box body, the compression strength of the packing box is increased, protection, safety and durability of the product are greatly improved, and more products can be stacked.

(3) Since one face of the packing box 20 is open, it can be easily arranged on the upper part or the lower part of the product.

(4) Since the side plate distal end portions 17 protruding from the frame columns 14 of the side plates 2 and 3 cover the side faces of the product, prevention of displacement of the packing box 20 or reduction of damage on the products placed side by side can be also realized.

(5) Since the packing box 20 is made from a corrugated fiberboard sheet, if the life as the packing box ends, it can be reused or recycled for other applications.

INDUSTRIAL APPLICABILITY

The peeking box according to the present invention can be used for packing of various products including electric products.

The invention claimed is:

1. A packing box that covers a top face of a product mounted on a pallet comprising, a rectangular bottom plate, four side plates erected from the periphery of the bottom plate and surrounding the bottom plate, and four frame columns formed by tucking parts extending from both ends of two side plates opposing each other out of the four side plates, the extended parts being narrower in width than the two side plates, the four frame columns extending midway to distal ends of the four side plates at four corners formed by the four side plates, the four frame columns being joined to the four side plates, the distal ends of the four side plates protruding from the four frame columns, the bottom plate, the four side plates and the four frame columns being formed by one corrugated fiberboard sheet, wherein each of the four side plates has a first through hole formed at a position facing one of the frame columns in each of both end portions of the side plates, each of the frame columns has a second through hole formed at a position facing the first through hole in a respective one of the side plates, and each of the frame columns is joined to each of two respective side plates forming the corners by a joining member inserted through the first through hole of each of the two respective side plates and the second through hole.

2. The packing box of claim 1, wherein a supporting material is filled in the frame columns.

3. The packing box of claim 1, wherein the frame columns are formed by winding the corrugated fiberboard sheet in multiple stages.

4. A manufacturing method of a packing box that covers a top face of a product mounted on a pallet, comprising:

punching one corrugated fiberboard sheet and forming a box board having a rectangular bottom plate, four side plates extending from individual sides of the bottom plate, and extended parts extending from both ends of each of two-opposing side plates, each plate on the bottom plate side out of the four side plates and each having of the extended parts being formed with a width smaller than a width of each of the side plates;

forming four frame columns by tucking each of the extended parts inward;

forming a box body by folding each of the side plates at the individual sides of the bottom plate such that distal end parts of each of the side plates protrude from the four frame columns;

arranging the four frame columns at four corners of the box body and joining them to the side plates; and joining each of the four frame columns to each of two respective side plates forming the corners by inserting a joining member into a first through hole formed in each of the respective side plates and a second through hole formed in each of the four frame columns at a position facing the first through hole in each of the respective side plates, the first through hole being preformed in each of both end portions of the side plates, and the second through hole being preformed in each of both end portions of the extended parts.

5. The manufacturing method of the packing box of claim 4, wherein when forming the frame columns by tucking the extended parts, the extended parts are tucked with a supporting material, such that the supporting material is contained within the frame columns.

6. The manufacturing method of the packing box of claim 4, wherein after forming the frame columns by tucking the extended parts, a supporting material is inserted into the frame columns.

7. The manufacturing method of the packing box of claim 4, wherein the frame columns are formed by tucking the extended parts at least doubly.

* * * * *